United States Patent [19]

Sasao

[11] 4,376,930

[45] Mar. 15, 1983

[54] CALL SIGNAL CONVERSION APPARATUS FOR ELEVATOR SYSTEM

[75] Inventor: Isao Sasao, Inazawa, Japan

[73] Assignee: Mitsubishi Denki Kabushiki Kaisha, Tokyo, Japan

[21] Appl. No.: 228,351

[22] Filed: Jan. 26, 1981

[30] Foreign Application Priority Data

Jan. 29, 1980 [JP] Japan ..... 55-9097

[51] Int. Cl.[3] ..... G08B 5/36

[52] U.S. Cl. ..... 340/19 R; 340/20; 340/654

[58] Field of Search ..... 340/19 R, 20, 21

[56] References Cited

U.S. PATENT DOCUMENTS 3,967,700 7/1976 Tur et al. ..... 340/21

4,120,381 10/1978 Otto et al. ..... 340/19 R

*Primary Examiner*—David L. Trafton

*Attorney, Agent, or Firm*—Oblon, Fisher, Spivak, McClelland & Maier

[57] ABSTRACT

A call signal conversion apparatus for an elevator system comprises a call button device as a serial connection of a call button and a call registration lamp; a control device as a computer for inputting a call signal given by actuation of the call button, registering the calling and outputting the call registration signal; and a signal conversion circuit connected between the button device and the control device. The signal conversion circuit comprises a call detection circuit for detecting the call signal; a waveform shaper circuit which shapes the call signal to output the signal to the control circuit; a memory circuit for memorizing the call signal or the call registration signal; and a driving circuit for outputting the signal for turning on or off the call registration lamp by detecting the output of the memory circuit.

7 Claims, 6 Drawing Figures

CALL SIGNAL CONVERSION APPARATUS FOR ELEVATOR SYSTEM

BACKGROUND OF THE INVENTION

1. Field of the Invention

The present invention relates to an improvement of a call signal conversion apparatus for an elevator system.

2. Description of the Prior Arts

The elevator system equipped with digital apparatus such as a computer need to have floor buttons and car buttons and registration lamps which are connected with the buttons to turn-on by each calling and a signal conversion circuit for converting signal to a control device of the computer.

Heretofore, the signal conversion circuit usually comprises independently a signal conversion circuit for call buttons and a signal conversion circuit for registration lamps as shown in FIG. 1.

In FIG. 1, the reference numeral (1) designates a call button; (2) designates an elevator control device; (3) designates a call button signal conversion circuit; (4) designates a call registration lamp; and (5) designates a call registration lamp signal conversion circuit. The call button signal conversion circuit (3) comprises a detection circuit for detecting the call signal resulted by the actuation of the call button (1); a conversion circuit for converting the signal required for transmitting the detected signal to the control device (2); and a logic circuit for transmitting and controlling the call data to the control device (2) depending upon the desired data command time given by the control device (2). In the control device (2) receiving the data from the call button signal conversion circuit (3), the calling is memorized (registered) and a turn-on command is transmitted to the call registration lamp signal conversion circuit (5) so as to turn-on the corresponding call registration lamp (4). The signal conversion circuit (5) comprises a logic circuit which controls the turn-on of the call registration lamp (4) by receiving the command from the control device (2) and a driving circuit which is actuated by the logic circuit so as to turn-on the call registration lamp (4) by the output of the driving circuit.

As mentioned above, the conversion circuit (3) and the conversion circuit (5) are the separate circuits whereby they can be also utilized as the other device such as a relay driving circuit and a position indicator driving circuit. However, the number of the relays is reduced depending upon the development of the control device (2) with semiconductors, though many relays had been used. Moreover, only the signal conversion circuits for service floors are needed for the position indicators. Therefore, the ratio of the signal conversion circuits for calling in the elevator system has been increased. In the conventional apparatus, the signal conversion circuit (3) for the button (1) and the signal conversion circuit (5) for the call registration lamp (4) have been separately needed, to cause useless circuit equipments. The number of the print boards has been increased to cause high cost for the signal conversions.

As signal lines from the call buttons to the elevator control panel, one line is needed for detecting the calling and one line in needed for turning on the call registration lamp. Three kinds of callings as the car call, the floor uphall call and downhall call are given. Therefore, six signal lines are needed for one floor. The number of the lines is increased in proportional to the number of the elevator service floors, whereby the cost and processes for construction are disadvantageously increased.

SUMMARY OF THE INVENTION

It is an object of the present invention to overcome the above-mentioned disadvantages and to provide a call signal conversion apparatus for an elevator system which has not useless equipments and is economical.

The foregoing and other objects of the present invention have been attained by providing a call signal conversion apparatus for an elevator system which comprises a call button device as a serial connection of a call button and a call registration lamp; a control device as a computer for inputting a call signal given by actuation of the call button, registering the calling and outputting the call registration signal; a signal conversion circuit connected between the button device and the control device wherein said signal conversion circuit comprises a call detection circuit for detecting the call signal; a waveform shaper circuit which shapes the call signal to output the signal to the control circuit; a memory circuit for memorizing the call signal or the call registration signal; and a driving circuit for outputting the signal for turning on or off the call registration lamp by detecting the output of the memory circuit.

DETAILED DESCRIPTION OF THE PREFERRED EMBODIMENTS

Referring to FIGS. 2 to 5, one embodiment of the present invention will be illustrated.

Figure 1:
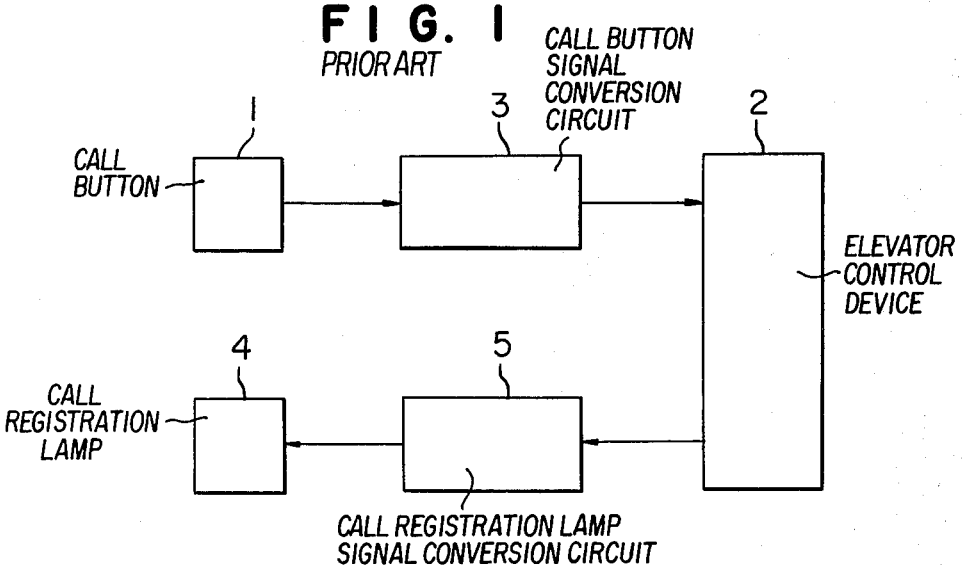
FIG. 1 PRIOR ART
FIG. 1 is a block diagram of the conventional call signal conversion apparatus for an elevator system.
Figure 2:
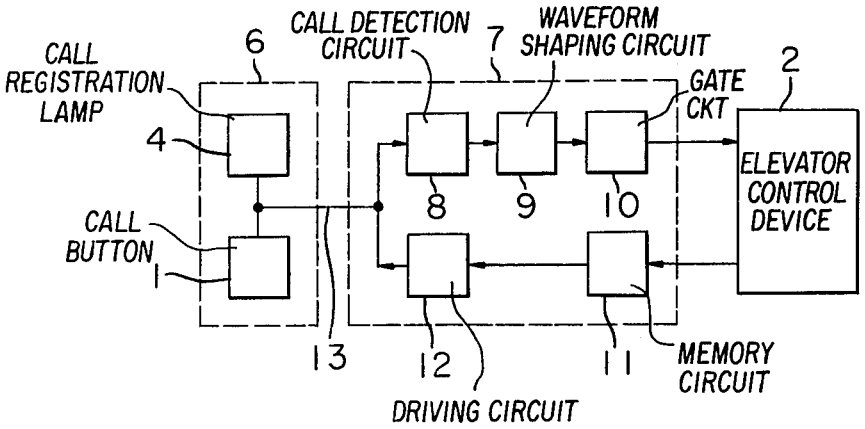
FIG. 2 is a block diagram of one embodiment of the call signal conversion apparatus for an elevator system according to the present invention.

In FIG. 2, the reference numeral (6) designates a call button device comprising one body of the call buttons (1) and the call registration lamps (4); (7) designates a signal conversion circuit comprising a call detection circuit (8), a waveform shaping circuit (9), a gate circuit (10), a memory circuit (11) and a driving circuit (12); (13) designates a common signal line for connecting the call button device (6) to the signal conversion circuit (7).

Figure 3:
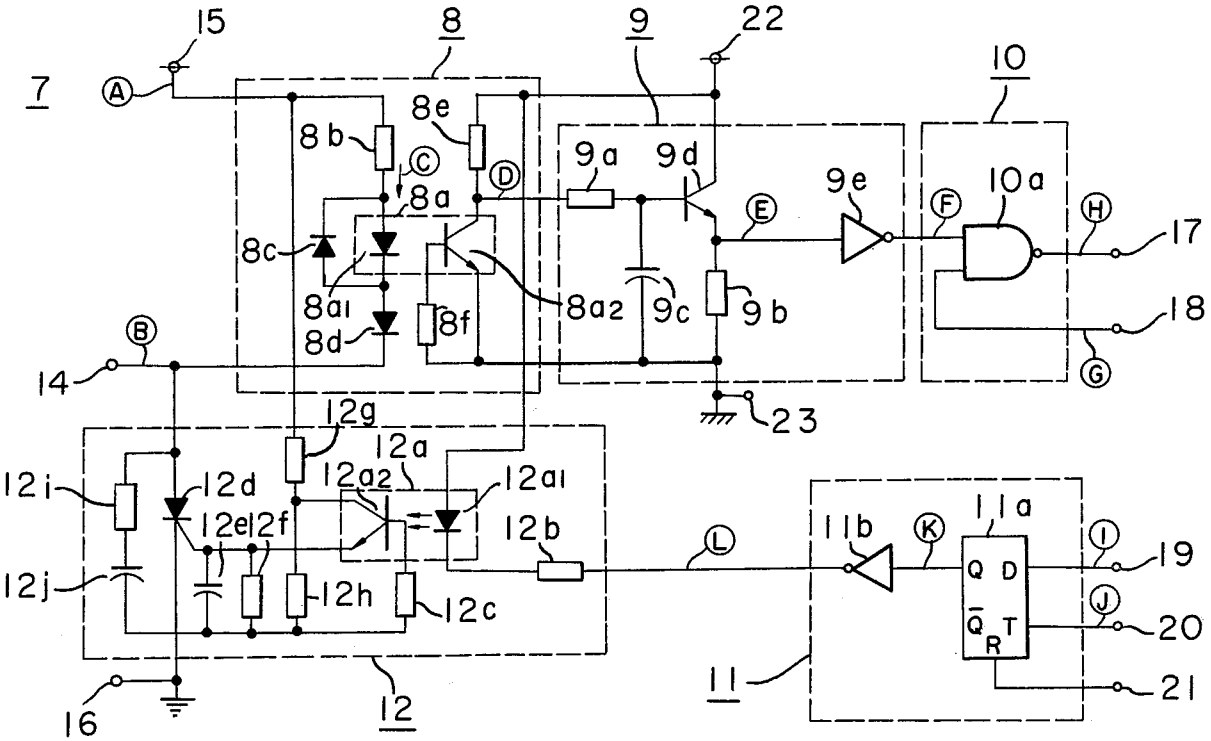
FIG. 3 is a circuit diagram of the signal conversion circuit (7) in FIG. 2.

In FIG. 3, the reference numeral (14) designates a call terminal for connecting to the common signal line (13) shown in FIG. 2; (15) designates a power source terminal in high voltage side to connect to the positive side of the single phase full wave rectifying power source such as AC 100 V full wave rectifying power source; (16) designates an earthing terming in the high voltage circuit to connect to the negative side of the single phase full wave rectifying power source; (17) to (21) designate terminal groups for connecting to the control device (2) shown in FIG. 2; (22) and (23) respectively designate a power source terminal and an earthing terminal in the low voltage circuit and the power source terminal (22) is connected to the positive side of the DC power source (such as DC power source having 5 volt) (not shown) and the earthing terminal (23) is connected to the negative side of the DC power source; (8*a*) designates a photocoupling device comprising a photodiode (8*a*1) and a phototransistor (8*a*2) which detects the call button signal and insulates between the high voltage circuit and the low voltage circuit; (8*b*) designates a current limiting resistor for the photodiode (8*a*1); (8*c*) designates a diode for protection from inversion withstand voltage; (8*d*) designates a diode for preventing reverse current passing from the call terminal (14) to the power source terminal (15); (8*e*) designates a collector resistor for the phototransistor (8*a*2); (8*f*) designates a base resistor. An emitter earthing amplifying circuit is formed by the phototransistor (8*a*2), the collector resistor (8*e*) and the base resistor (8*f*). The reference numerals (9*a*), (9*b*) respectively designate resistors; (9*c*) designates a capacitor; (9*d*) designates a transistor; (9*e*) designates an inverter. The resistor (9*a*) and the capacitor (9*c*) form a CR filter circuit. The output of the filter circuit is amplified by the collector earthing amplifying circuit (emitter follower) comprising the transistor (9*d*) and the resistor (9*b*). The inverter (9*e*) causes the inversion of the logical level of the signal and the shaping of the signal for slow raising or falling time into the signal for fast raising and falling time signal. The reference numeral (10*a*) designates an NAND gate, and the output of the inverter (9*e*) is connected to one of the input terminal; and the other input is connected to the terminal (18) and the output is connected to the terminal (17), and the call data command timing signal is given from the control device (2) to the terminal (18). The reference numeral (11*a*) designates a flip-flop (1 bit memory) which comprises a data input terminal D, a timing input terminal T and a reset input terminal R which are respectively connected to the terminals (19) to (21) which are connected to the control device (2). The flip-flop (11*a*) is set(to turn-on the all registration lamp (4)) or reset (to turn-off the same) depending upon the data given to the data input terminal D under synchronizing to the timing signal given to the timing input terminal T. The signal for controlling all of the flip-flops (11*a*) for each calling to the reset state is applied to the reset input terminal R at the initiation such as the actuation of the power source of the elevator system. The reference numeral (11*b*) designates an inverter having a large output current capacity which amplifys the output (Q terminal) of the flip-flop (11*a*) to drive the driving circuit (12) connected to the next step. When the driving circuit (12) can be directly actuated by the flip-flop (11*a*), it is unnecessary to use the inverter (11*b*). In this case, the output signal given from the $\overline{Q}$ terminal is applied. The reference numeral (12*a*) designates a photocoupling device comprising a photodiode (12*a*1) and a phototransistor (12*a*2) which detects the call registration lamp signal and insulates between the high voltage circuit and the low voltage circuit; (12*b*) designates a current limiting resistor for the photodiode (12*a*1); (12*c*) designates a base resistor for the phototransistor (12*a*2) to stabilize the phototransistor (12*a*2). The reference numeral (12*d*) designates a thyristor for turning on the call registration lamp (4); (12*e*) designates a capacitor; (12*f*) designates a resistor which is needed for stable operation of the thyristor (12*d*); and (12*g*) and (12*h*) respectively collector voltage limiting resistors for the phototransistor (12*a*2) to have the function for controlling the gate current of the thyristor (12*d*); and (12*i*) designates a resistor; (12*j*) designates a capacitor; and the resistor (12*i*) and the capacitor (12*j*) form a CR surge absorber which has the function for stabilization of the operation and elimination of outer noise given through a call terminal (14).

Figure 4:
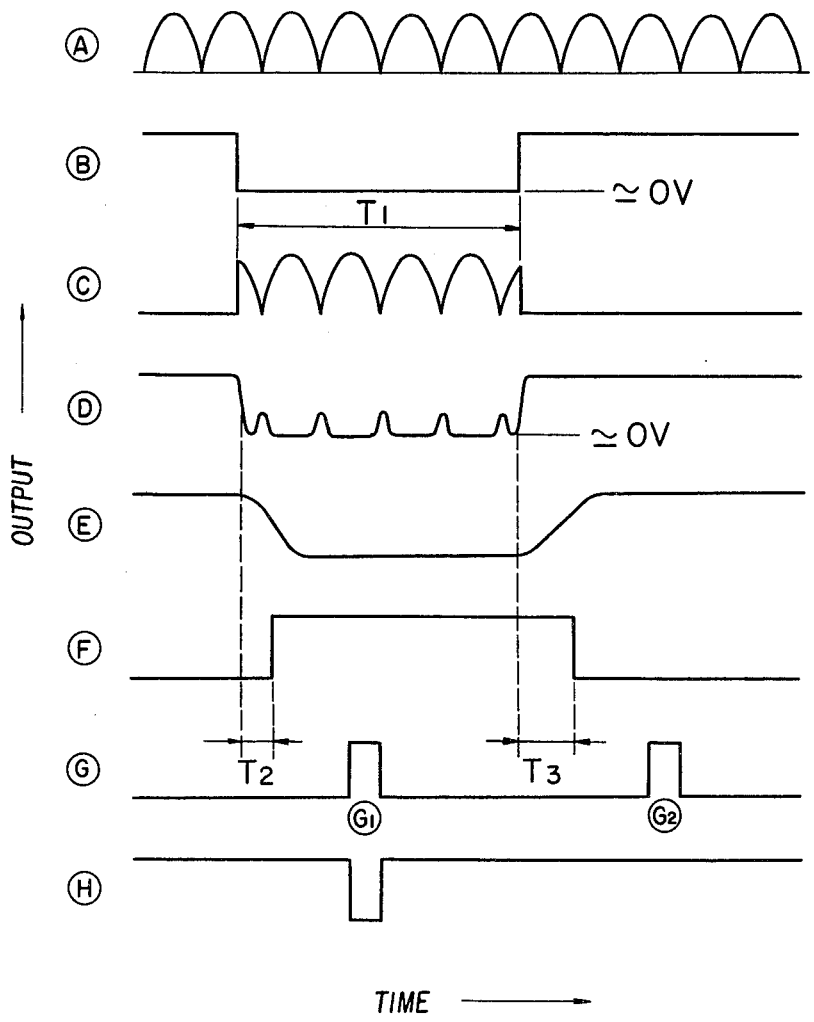
FIGS. 4 and 5 are graphs of signals at selected points of the circuit shown in FIG. 3.
Figure 5:
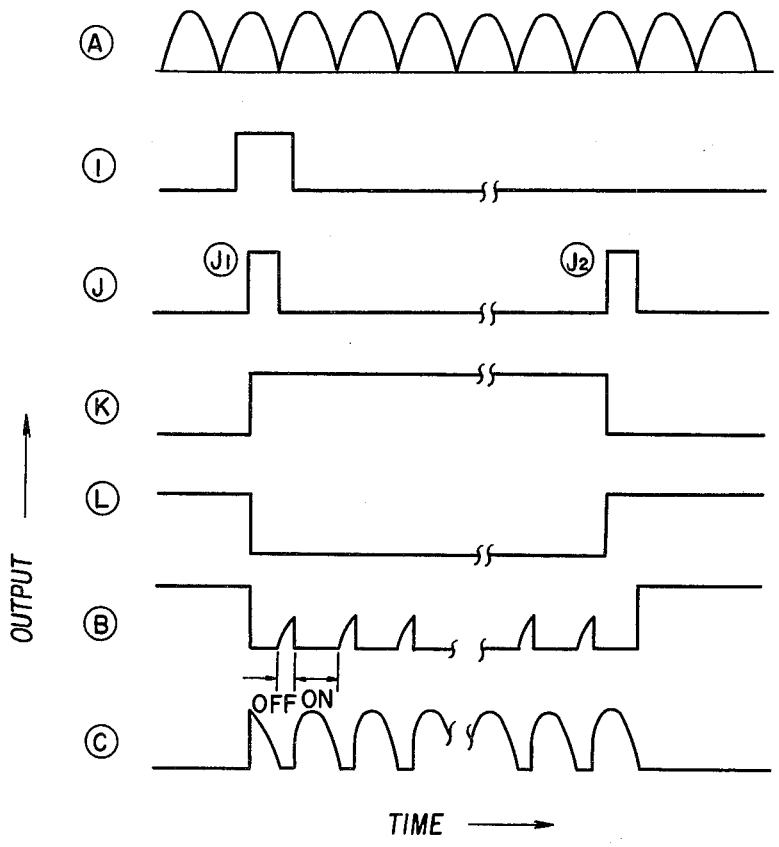

Referring to FIGS. 4 and 5, the operation of the embodiment will be illustrated.

The single phase full wave rectifying voltage Ⓐ is applied to the terminal (15).

The voltage Ⓑ at the call terminal (14) is changed to be low level by pushing the call button (1) whereby the circuit of (15)-(8*b*)-(8*a*1)-(8*d*)-(14)-(13)-(1) is formed. In the state, the pulse current Ⓒ passes through the photodiode (8*a*1) to the arrow direction depending upon the power source voltage Ⓐ for the time $T_1$ pushing the call button (1). When the current Ⓒ is larger than a desired current, the phototransistor (8*a*2) is in the saturating state whereby the collector voltage Ⓓ of the phototransistor (8*a*2) is substantially zero. When the current Ⓒ decreases, the phototransistor (8*a*2) changes into the active region to output the voltage in proportional to the current Ⓒ. The transistor (9*d*) is turned on by the voltage Ⓓ applied through the CR filter circuit and the output voltage Ⓔ has the waveform for gradually raising or falling in the raising or falling of the voltage Ⓓ. The output of the inverter (9*e*) i.e. the output of the waveform shaping circuit (9) inverts the waveform of the voltage Ⓓ and gives the waveform for faster raising time and falling time. Thus, when the call signal is applied to the input terminal of the NAND gate (10*a*) after the period $T_2$ from the turn-on of the call button (1) and the call button (1) is turned off, the off state is transmitted after the period $T_3$.

On the other hand, when the call data are required, the data requirement timing signal Ⓖ is transmitted from the control device (2) as shown in $G_1$ in the ON state of the call button (1) and $G_2$ in the OFF state of the call button (1). The output voltage Ⓗ of the NAND gate gives "L" level only in the ON state of the call button (1) to transmit the call signal through the terminal (17) to the control device (2).

When the control device (2) registers the calling by the output Ⓗ of the gate circuit (10), the call registration signal Ⓘ inputs to the terminal (19). The signal is the turn-on signal for the call registration lamp (4) in "H" level of the data signal whereas it is the turn-off signal in "L" level of the data signal. The reference Ⓙ designates a timing signal. The memory device (11*a*) is set by the timing signal $J_1$ to give the output Ⓚ in "H" level. The memory device (11*a*) is reset by the timing signal $J_2$ to give the output Ⓚ in "L" level. The output Ⓛ of the inverter (11*b*) has reverse polarity to the output Ⓚ. When the memory device (11) is set to give the output Ⓛ in "L" level, the photocoupling device (12*a*) is actuated to turn-on the thyristor (12*d*) by the output. The call registration lamp (4) is turned on by the circuit of (15)-(4)-(13)-(14)-(12*d*)-(16). The voltage Ⓑ at the call terminal (14) and the current Ⓒ of the photodiode (8*a*1) have slightly different waveforms as shown in FIG. 5 from the waveforms shown in FIG. 4. The phenomenon is caused by the actuation of the thyristor (12*d*) by the waveform of the power source voltage Ⓐ. During the turn-on of the call registration lamp (4), the thyristor (12*d*) is repeatedly turned on and off.

Thus, the call registration lamp (4) is turned on by pushing the call button (1) and the signal equivalent to the pushing of the call button (1) is simultaneously transmitted through the call detection circuit (8) to the control device (2).

The call signal is transmitted through the cable connecting the control device (2) equipped in an elevator machine room to the call buttons (1) equipped in the car or the hall whereby certain effect of outer noise is easily given. The outer noise, however, can be eliminated by the filter function of the waveform shaping circuit (9) as one of the elements of the signal conversion circuit (7). Therefore, it is unnecessary to connect a special circuit for preventing the noise.

Figure 6:
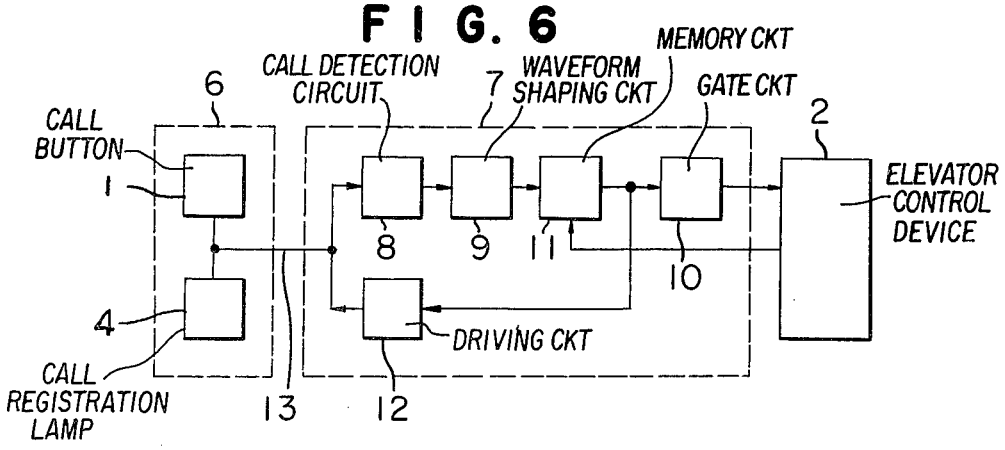
FIG. 6 is a block diagram of the other embodiment of the apparatus according to the present invention.

FIG. 6 shows the other embodiment of the present invention.

The elements of the embodiment shown in FIG. 6 have equivalent functions to those of the elements shown in FIG. 2 and accordingly, the description of these elements is not repeated. The different structure from the embodiment shown in FIG. 2 is to actuate the memory circuit (11) directly by the output of the waveform shaping circuit (9). The memory circuit (11) is set by pushing the call button (1) to actuate the driving circuit (12) without using the control device (2) to turn-on the call registration lamp (4). In the control device (2) of this embodiment, the call data read-in function is the same as that of FIG. 2, however, it outputs the reset signal to the memory circuit (11) only when the call registration lamp (4) is turned off whereby the memory circuit (11) is reset to turn-off the call registration lamp (4).

As the memory circuit (11), the memory circuit for setting or resetting under synchronizing to the timing signal, is used in the embodiment shown in FIG. 3, whereas the memory circuit for setting by raising or falling change of the signal is used in the embodiment shown in FIG. 5.

In these embodiments, the circuit for only one calling is shown. In the practical system, n circuits in parallel are needed for n callings. In these embodiments, the transistor circuit of the call detection circuit (8) is the emitter earthing amplifying circuit, however, it can be a collector earthing amplifying circuit. As the amplifying circuit of the waveform shaping circuit (9), the collector earthing amplifying circuit can be an emitter earthing amplifying circuit.

The memory circuit (11) is formed by the D flip-flop having the D and T terminals, however, a memory circuit having the other circuit element such as RS flip-flop or JK flip-flop can be used.

The thyristor is used in the driving circuit (12), however, the other semiconductor device such as a two way thyristor and a transistor or a mechanical part such as a relay can be used for the driving circuit (12). The photocoupler element (8*a*) is used for the insulation of the high voltage circuit from the low voltage circuit, however, it is possible to receive directly by the transistor in the case of the call detection circuit (8) and it is possible to actuate the driving circuit (12) directly by the output of the IC circuit.

An inversion signal can be also used as the signal between the signal conversion circuit (7) and the control device (2) beside the signals shown in FIGS. 4 and 5. This can be easily given by the addition of an inverter or the formation of the NAND gate by an AND gate. It is also easy to add a circuit for using the timing signal as a codified signal and decoding to the signal conversion circuit (7).

As described above, in accordance with the present invention, the signal conversion circuit connected between the call button device and the control circuit is formed by the call detection circuit for detecting the call signal; the waveform shaping circuit for shaping the call signal; the memory circuit for memorizing the call registration signal and the driving circuit for turning on and off the call registration lamp by the output of the memory circuit, whereby the functional elements required for the transmission and receiving of the signal can be combined into one to improve the density of equipped elements on the print wiring boards and to reduce the number of the print wiring boards and to reduce the cost for the signal conversion circuit.

I claim:

1. In a call signal conversion apparatus for an elevator system which comprises a call button device as a serial connection of a call button and a call registration lamp; a control device as a computer for inputting a call signal given by actuation of the call button, registering the calling and outputting a call registration signal; and a signal conversion circuit connected between said button device and said control device an improvement characterized in that said signal conversion circuit comprises a call detection circuit for detecting said call signal; a waveform shaper circuit which shapes said call signal to output the signal to said control device; a memory circuit having an input coupled to the control device for memorizing said call signal or said call registration signal from the control device; and a driving circuit for outputting a signal for turning on or off said call registration lamp by detecting an output of said memory circuit and for supplying a signal equivalent to said call signal to said control device through said call detection circuit and said waveform shaper circuit.

2. The call signal conversion apparatus according to claim 1 wherein said memory circuit is actuated by said waveform shaper circuit.

3. The call signal conversion apparatus according to claim 1 wherein said call detection circuit has an emitter earthing amplifying circuit.

4. The call signal conversion apparatus according to claim 1 wherein said waveform shaper circuit has a collector earthing amplifying circuit.

5. The call signal conversion apparatus according to claim 1 wherein said memory circuit is a flip-flop circuit.

6. The call signal conversion apparatus according to claim 1, wherein said call detection circuit has a collector earthing amplifying circuit.

7. The call signal conversion apparatus according to claim 1, wherein said waveform shaper circuit has an emitter earthing amplifying circuit.

* * * * *